US007753728B2

(12) United States Patent
Ikeya et al.

(10) Patent No.: US 7,753,728 B2
(45) Date of Patent: Jul. 13, 2010

(54) REAR-COVER ATTACHMENT STRUCTURE

(75) Inventors: Kenichi Ikeya, Shizuoka-ken (JP); Nozomi Ito, Tochigi-ken (JP); Shigeru Tanaka, Shizuoka-ken (JP); Yasuhiro Sasaki, Shizuoka-ken (JP)

(73) Assignees: Yazaki Corporation, Tokyo (JP); Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 11/663,452

(22) PCT Filed: Sep. 6, 2005

(86) PCT No.: PCT/JP2005/016304

§ 371 (c)(1),
(2), (4) Date: Mar. 4, 2008

(87) PCT Pub. No.: WO2006/033230

PCT Pub. Date: Mar. 30, 2006

(65) Prior Publication Data

US 2008/0220659 A1 Sep. 11, 2008

(30) Foreign Application Priority Data

Sep. 24, 2004 (JP) ..... 2004-277885

(51) Int. Cl.
*H01R 13/40* (2006.01)

(52) U.S. Cl. ..... 439/587; 439/588

(58) Field of Classification Search ..... 439/447, 439/468, 559, 587, 588, 694
See application file for complete search history.

(56) References Cited

U.S. PATENT DOCUMENTS

| | | | | |
|---|---|---|---|---|
| 5,240,433 | A * | 8/1993 | Kato | 439/587 |
| 5,395,266 | A * | 3/1995 | Abe et al. | 439/587 |
| 5,613,868 | A * | 3/1997 | Ohsumi et al. | 439/275 |
| 5,618,198 | A * | 4/1997 | Sato et al. | 439/274 |
| 5,971,791 | A | 10/1999 | Itoh et al. | |
| 6,196,872 | B1 * | 3/2001 | Murakami et al. | 439/587 |
| 6,254,431 | B1 * | 7/2001 | Murakami et al. | 439/587 |
| 6,494,731 | B1 * | 12/2002 | Suzuki | 439/275 |
| 6,568,967 | B2 * | 5/2003 | Inaba et al. | 439/701 |

(Continued)

FOREIGN PATENT DOCUMENTS

JP 64-023885 2/1989

(Continued)

OTHER PUBLICATIONS

European Search Report dated Sep. 21, 2007.

(Continued)

*Primary Examiner*—Thanh-Tam T Le
(74) *Attorney, Agent, or Firm*—Finnegan, Henderson, Farabow, Garrett & Dunner, L.L.P.

(57) ABSTRACT

A fixation structure for a rear cover (1) in which a waterproofing grommet (5) is fixed to the wire lead-out side (4), from which a wire from a connector housing (2) is led out, of a connector (3) and which is assembled to the wire lead-out side (4) of the connector for (3) with the waterproofing grommet (5) in between. The grommet (5) is provided with a rib (7) that is in contact with the inner wall (protrusion (34)) (6) to hold the attitude of the grommet (5) relative to the rear cover (1).

2 Claims, 5 Drawing Sheets

U.S. PATENT DOCUMENTS

| | | | | |
|---|---|---|---|---|
| 6,872,092 | B2 * | 3/2005 | Oka | 439/587 |
| 6,971,905 | B2 * | 12/2005 | Makita et al. | 439/447 |
| 7,156,698 | B2 * | 1/2007 | Yamashita | 439/587 |

FOREIGN PATENT DOCUMENTS

| | | |
|---|---|---|
| JP | 04-078772 | 7/1992 |
| JP | 7-263068 | 10/1995 |
| JP | 8-330019 | 12/1996 |
| JP | 09-092372 | 4/1997 |
| JP | 10-074557 | 3/1998 |
| JP | 10-092510 | 4/1998 |
| JP | 2001-244014 | 9/2001 |
| JP | 2002-198127 | 7/2002 |

OTHER PUBLICATIONS

Japanese Patent Office, Official Communication, Jan. 26, 2009, 2 pages.

* cited by examiner

REAR-COVER ATTACHMENT STRUCTURE

CROSS-REFERENCE TO RELATED APPLICATIONS

This application is a national phase application of International Application No. PCT/JP2005/016304, filed Sep. 6, 2005, and claims the priority of Japanese Application No. 2004-277885, filed Sep. 24, 2004, the content of all of which is incorporated herein by reference.

TECHNICAL FIELD

The present invention relates to a rear-cover attachment structure for attaching a rear cover from outside of a grommet to a wire-led side of a connector housing.

BACKGROUND ART

There is known a structure for attaching a cover for waterproof or sound insulation to a wire-led side of a connector wires of which are led from terminals within a connector housing (Japanese Patent Application Laid-open No. H07-263068). With this structure, a plurality of male connectors are inserted into the cover, and the wires led from the wire-led side are accommodated in a wire accommodating member and led out from a leading outlet. This cover is made of soft synthetic rubber and attached to the connector housing via a seal member. The cover can prevent entry of water and transmission of sound from a wire-led side of a male connector.

DISCLOSURE OF THE INVENTION

Meanwhile, the cover (grommet) is attached to the connector to prevent entry of water and sound insulation from the wire-led side of the connector, thereby improving sealing property and sound-insulating property. However, because the cover is generally made of a soft material such as synthetic rubber, the cover is often damaged by abutting against a sharp corner or the like of a surrounding member at the time of handling. Therefore, it is proposed to assemble a rear cover with the wire-led side of the male connector to protect the waterproof cover from being directly exposed to the outside.

Since the cover is firmly attached to the wire-led side of the male connector via the seal member, no backlash occurs between the male connector and the cover. However, if the rear cover is assembled with the wire-led side of the male connector, backlash occurs between the male connector and the rear cover.

Furthermore, portions in which lock arms or the like for preventing the backlash are restricted due to the need to provide notches from which a plurality of wires inserted into the cover are led outside. It is, therefore, difficult to prevent backlash of the rear cover when assembling the rear cover with the wire-led side of the male connector.

It is, therefore, an object of the present invention to provide a rear-cover attachment structure that protects a waterproof grommet attached to a wire-led side of a connector housing, and that can prevent backlash in a state where a rear cover is being assembled with the wire-led side of the connector housing by holding an attitude of the grommet with respect to the rear cover.

According to an aspect of the present invention, there is provided a rear-cover attachment structure comprising: a connector in which a wire is led from a terminal within a connector housing; a grommet attached to a wire-led side of the connector; and a rear cover assembled with the wire-led side of the connector while the grommet is present between the rear cover and the connector, wherein the grommet has an attitude-holding rib that holds an attitude of the grommet with respect to the rear cover by abutting on an inner wall of the rear cover.

With this attachment structure, the waterproof grommet is attached to the wire-led side of the connector housing, and the attitude-holding rib of the grommet abuts on the inner wall of the rear cover when the rear cover is assembled with the wire-led side of the connector. The rear cover can be thereby assembled with the connector housing via the grommet assembled with the wire-led side of the connector housing without backlash.

Furthermore, the rear-cover attachment structure can be configured so that a protruding member abutting on the attitude-holding rib is provided on the inner wall of the rear cover, and so that the attitude-holding rib and the protruding portion have line contact with each other.

With this attachment structure, at the time of abutment of the attitude-holding rib on the wall member of the rear cover, the attitude-holding rib abuts on the wall member in line contact. Due to this, repellent force applied at the time of attaching the rear cover to the wire-led side of the connector housing is low. It is, therefore, possible to attach the rear cover to the wire-led side of the connector housing with low operating force.

With the above constitution, because of the low repelling force applied at the time of attaching the rear cover to the wire-led side of the connector housing, it is possible to attach the rear cover to the wire-led side of the connector housing with small operating force and to facilitate assembly.

BEST MODE FOR CARRYING OUT THE INVENTION

Figure 1:
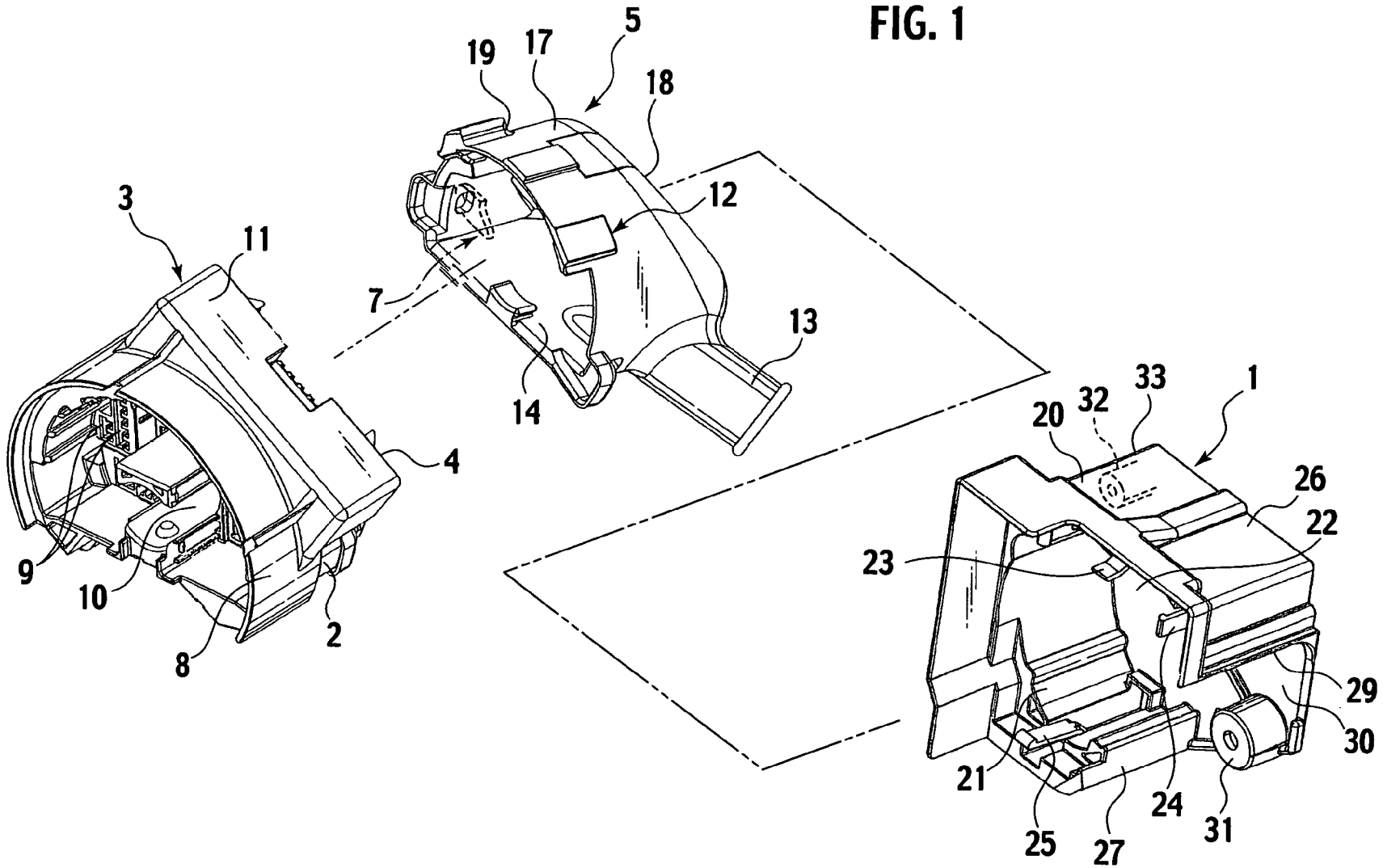
FIG. 1 is an exploded perspective view of an embodiment of the present invention, and showing a connector, a grommet attached to a wire-led side of the connector, and a rear cover assembled with the wire-led side of a connector housing while the grommet is present between the rear cover and the connector housing.

Embodiments of the present invention will be explained below with reference to the drawings.

An attachment structure of a rear cover 1 according to the embodiment of the present invention is such that a grommet 5 is attached to a wire-led side 4 of a connector 3 wires of which are led from respective terminals within a connector housing 2, and such that the rear cover 1 is assembled with the wire-led side 4 of the connector 3 while this grommet 5 is present between the rear cover 1 and the connector 3. With the attachment structure, an inner wall 6 of the rear cover 1 abuts on the grommet 5, and attitude-holding ribs 7 that hold an attitude of the grommet 5 with respect to the rear cover 1 are provided integrally with the grommet 5.

As shown in FIG. 1, in the connector 3, a fitted hood member 8 to be fitted into the other connector is formed into a generally cylindrical shape on one side, and a connector housing 2 in which a plurality of terminal-accommodating chambers 9 that accommodate therein the terminals is provided on the other side. Furthermore, an insertion hole 10 into which a rotational lever for fitting the connector 3 into the other connector (not shown) is inserted is formed in a central portion of the connector housing 2. An assembly wall member 11 with which the rear cover 1 is to be assembled is formed on the wire-led side 4 of the connector housing 2. The grommet 5 is attached to the wire-led side 4.

The grommet 5 is formed out of a cover member 12 that covers up the wire-led side 4 of the connector housing 2 and a wire-leading cylindrical member 13 formed integrally with the cover member 12. An opening 14 of the cover member 12 is formed into a semicircular shape so as to be similar to a shape of the wire-led side 4 of the connector housing 2. Engagement protrusions 15 and 16 to be engaged with the connector housing 2 are formed on an edge of the opening 14 (see FIG. 3).

Furthermore, trapezoidal attitude-holding ribs 7, 7 are provided on opposite side to the wire-leading cylindrical member 13 to be integral with an outer circumferential surface 17 of the cover member 12. Each of the attitude-holding members 7, 7 is formed out of inclined surfaces 7*a*, 7*a* rising from the outer circumferential surface 17 and a flat abutment surface 7*b*, 7*b*.

Figure 2:
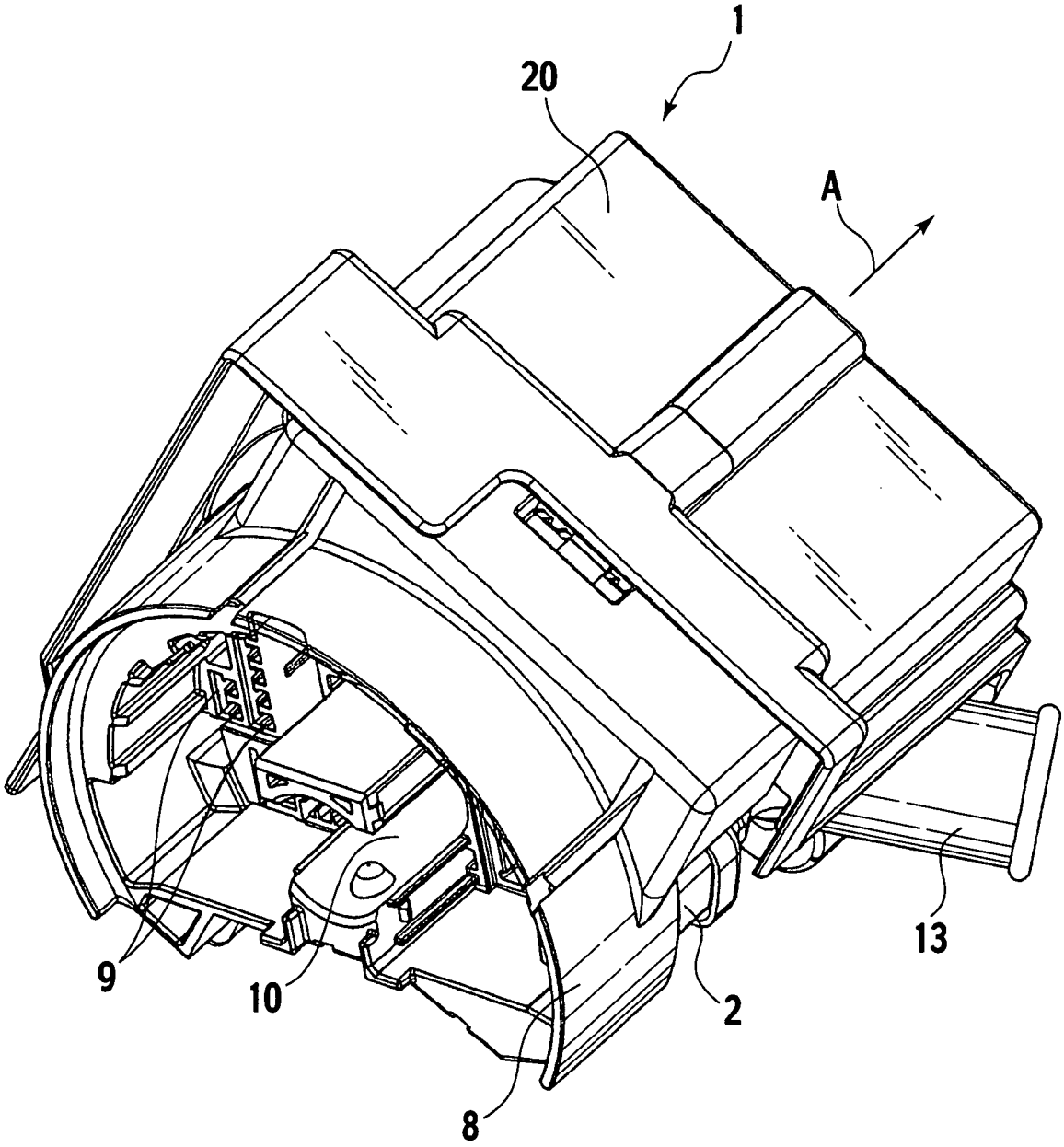
FIG. 2 is a perspective view of the embodiment of the present invention, and showing a state where the connector, the grommet, and the rear cover are assembled together.
Figure 3:
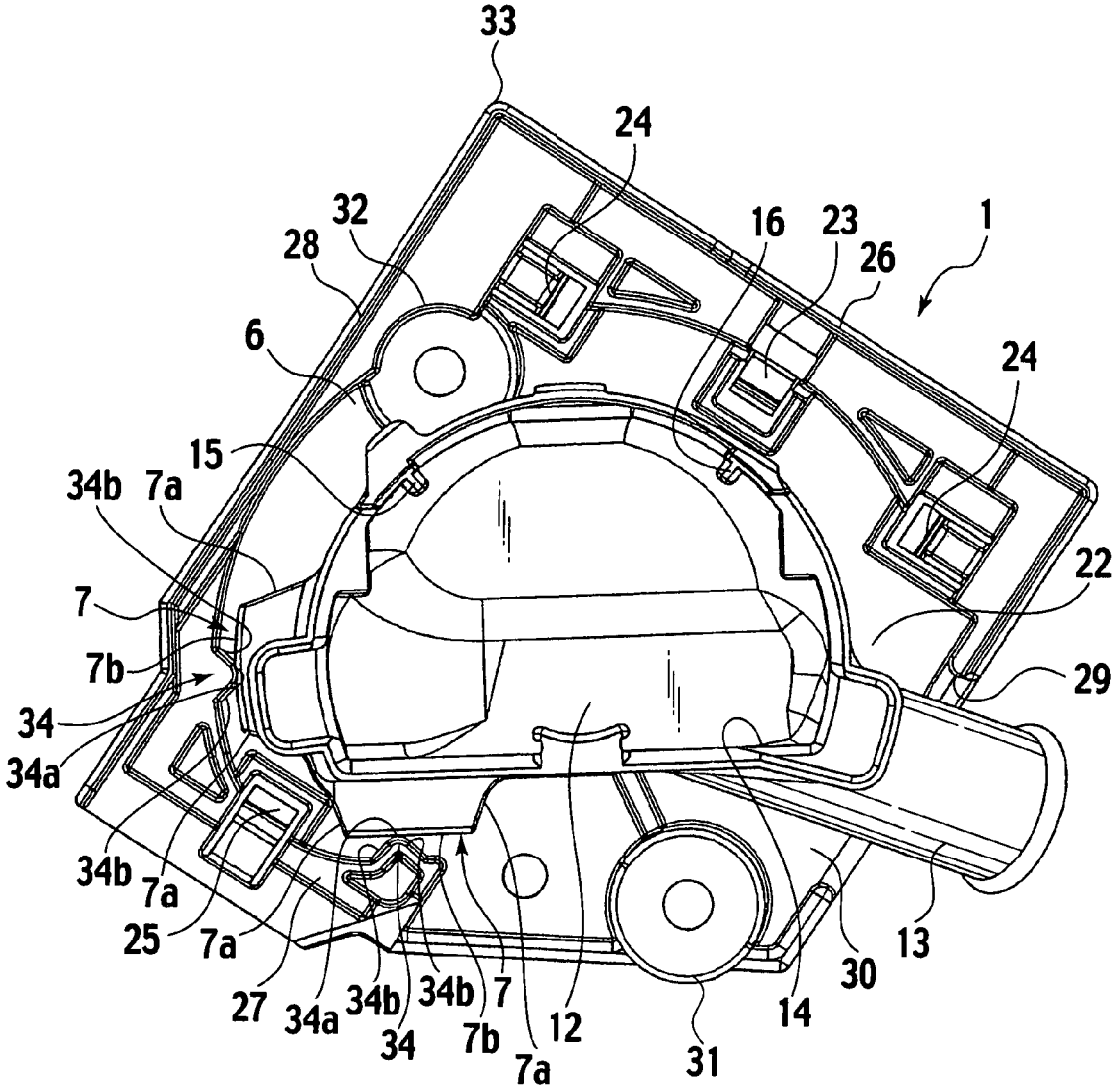
FIG. 3 is a front view of the embodiment of the present invention, and showing an opening side of the grommet and the rear cover on the rear-end side of the grommet and a state where backlash-proof ribs abut on an inner wall.
Figure 4:
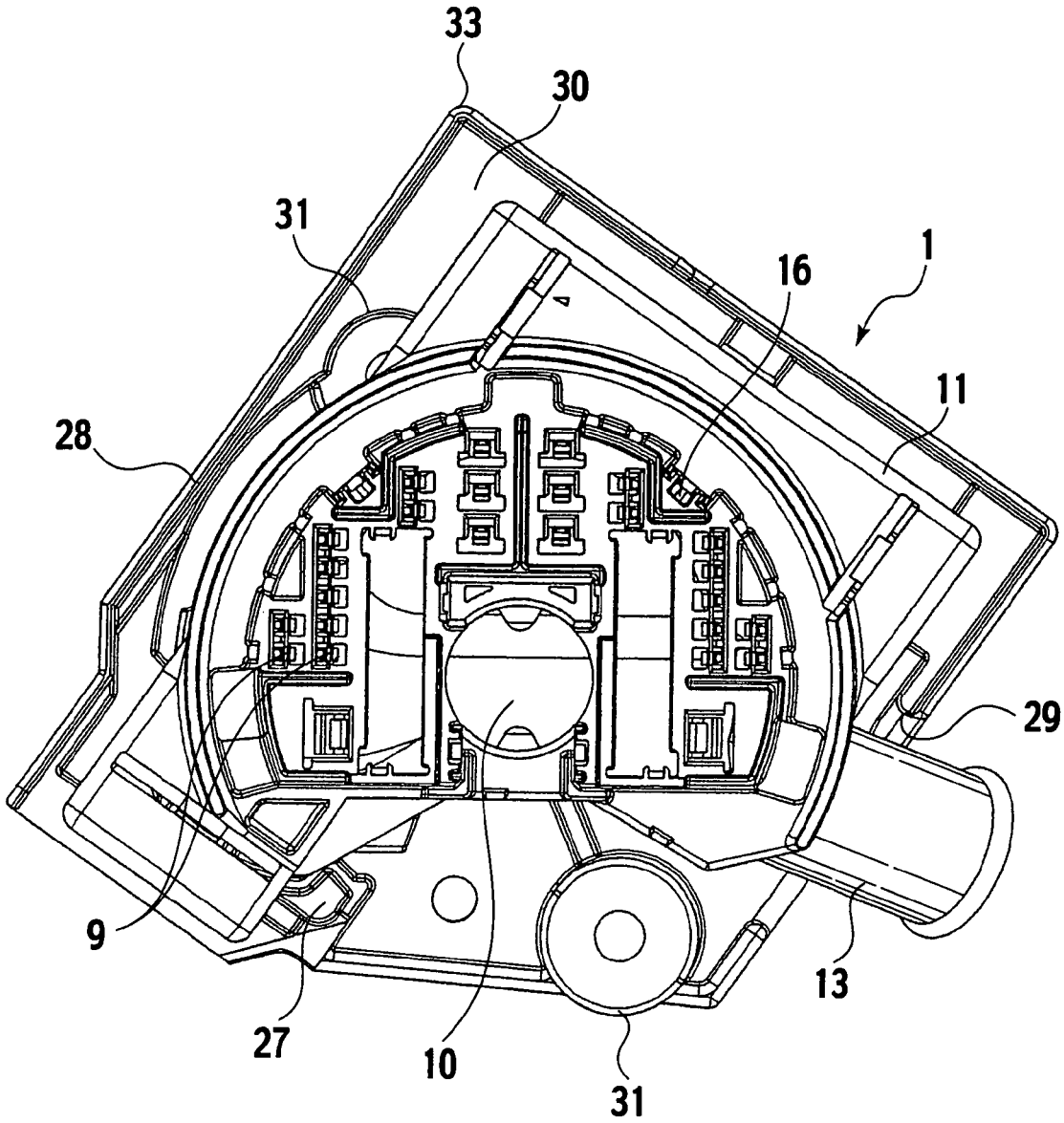
FIG. 4 is a front view showing the connector housing and the rear cover in the state shown in FIG. 3.
Figure 5:
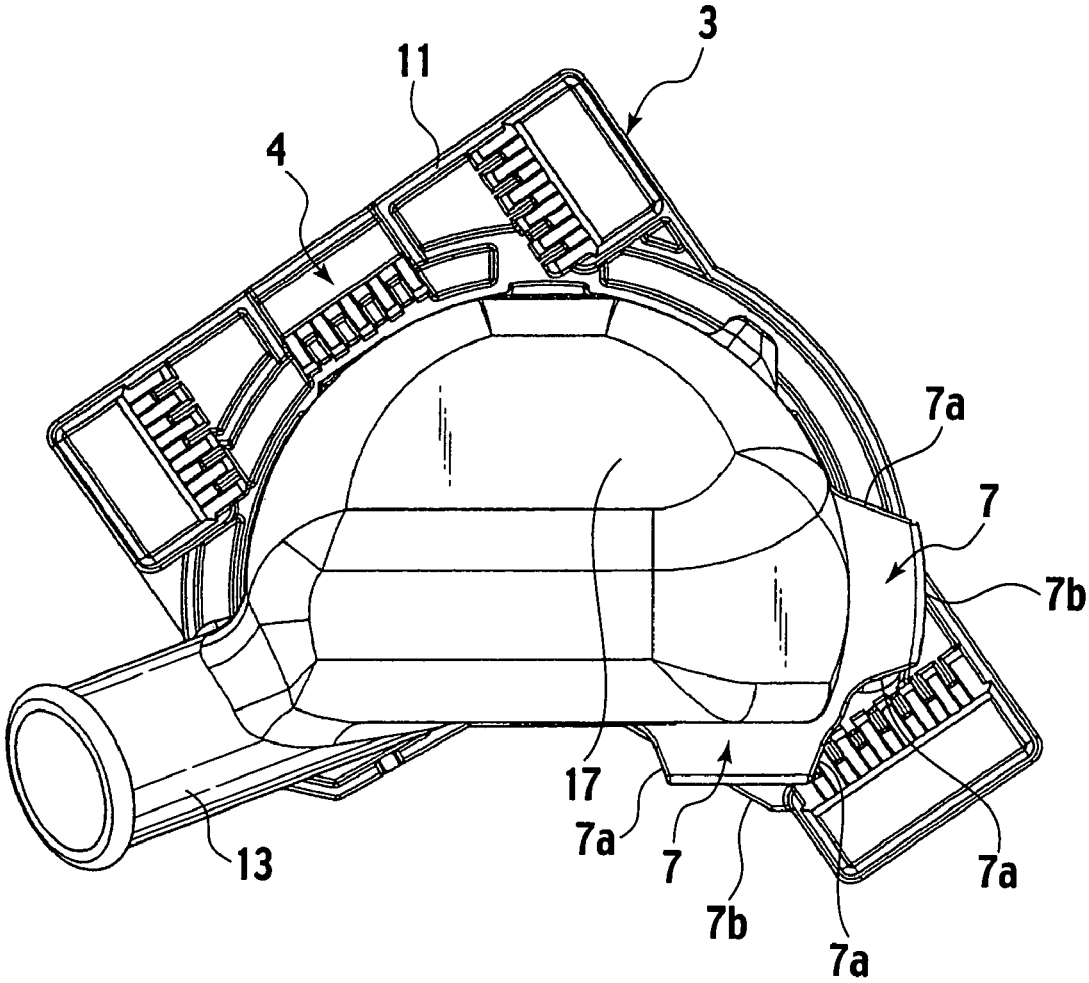
FIG. 5 is a back view of the embodiment of the present invention, and showing the rear-end side of the grommet and the wire-led side of the connector housing.

As shown in FIGS. 1 to 3, the rear cover 1 is formed into a rectangular box shape, an assembly opening 21 is formed on one side of a cover main body 20, and a grommet-accommodating member 22 is formed on the other side integrally. Three lock arms 23, 24, and 25 protrude from an opening edge of the assembly opening 21. These lock arms 23, 24, and 25 are engaged with the assembly wall member 11 of the connector 3 to assemble the rear cover 1 with the wire-led side 4 of the connector 3. The grommet accommodating member 22 is formed out of an upper wall 26, a lower wall 27 opposed to the upper wall 26, and sidewall 28 connecting the upper wall 26 to the lower wall 27. Further, a leading opening 29 from which the wire-leading cylindrical member 13 of the grommet 5 is to be led outside is formed between the upper wall 26 and the lower wall 27. Two cylindrical convex portions 31 and 32 protrude from a bottom wall 30 of the grommet accommodating member 22. One convex portion 31 is provided on a side of the leading-opening 29 whereas the other convex portion 32 is provided on a side of a connecting member 33 that connects the upper wall 26 to the sidewall 28. Holes are provided respectively in central portions of these convex portions 31 and 33 to serve as screw fixed portions at the time of attaching the grommet 5 to a body (glove box).

As shown in FIG. 3, protruding members 34, 34 are provided on the lower wall 27 and the sidewall 28, respectively. The protruding member 34 is formed into an angular shape by an abutment top portion 34*a* on its tip end and two inclined portions 34*b* reaching the lower wall 27 or the sidewall 28 from the abutment top portion 34*a*. The abutment top portions 34*a* have line contact with the abutment surfaces 7*b*, 7*b* of the attitude-holding ribs 7, 7, respectively.

To attach the grommet 5 onto the rear end 4 of the connector 3 and to assemble the rear cover 1 with the rear end 4 thereof, the wires (not shown) led from the rear end 4 of the connector 3 are inserted into the cover member 12 of the grommet 5 and led outside from the wire-leading cylindrical member 13. Next, the grommet 5 is moved toward the rear end 4 of the connector 3 and the engagement protrusions 15 and 16 are engaged with the rear end of the connector housing 2. From this state, the rear cover 1 is positioned with respect to the wire-led side 4 of the connector housing 2 and assembled with the assembly wall member 11 by the lock arms 23, 24, and 25. At this time, the abutment top portions 34*a*, 34*a* abut on the abutment surfaces 7*b*, 7*b* of the attitude-holding ribs 7, 7, respectively.

Accordingly, the attitude of the grommet 5 assembled with the wire-led side 4 of the connector housing 2 is held by the rear cover 1, whereby the rear cover 1 can be assembled with the wire-led side of the connector housing 2 via the grommet 5 without backlash.

Moreover, the abutment top portion 34*a* of the protruding member 34 abuts on the abutment surface 7*b* of the attitude-holding rib 7 in line contact. Due to this, resistance is low when the rear cover 1 is assembled with the wire-led side 4 of the connector housing 2, thereby making it possible to reduce operating force during assembly and to facilitate assembling the rear cover 1 with the connector housing 2.

Furthermore, in the present embodiment, the wire-leading cylindrical member 13 protrudes outward through the leading opening 29. It is, therefore, possible to restrict rotation of the rear cover 1 and prevent the rear cover 1 from rotating with respect to the connector housing 2.

Moreover, the grommet 5 in the present embodiment includes not only a waterproof function but also a sound-insulating function for insulating sound from one side to the other side of a panel or the like if this connector 3 is attached to the panel or the like.

In the present embodiment, the two attitude-holding ribs 7 and 7 are provided on the outer circumferential surface of the grommet 5. Alternatively, backlash-proof ribs 7 can be provided in two or more portions, respectively.

In the present embodiment, the protruding members 34 are provided on the lower wall 27 and the sidewall 28, respectively to abut on the grommet 5. However, any parts can be caused to abut on the grommet 5 as long as they are provided on the inner wall 6.

INDUSTRIAL APPLICABILITY

According to the present invention, it is possible to provide a rear-cover attachment structure that protects a waterproof grommet attached to a wire-led side of a connector housing and that can prevent the occurrence of backlash in a state where a rear cover is being assembled with the wire-led side of the connector housing by holding the attitude of the grommet with respect to the rear cover.

The invention claimed is:

1. A rear-cover attachment structure comprising:

a connector in which a wire is led from a terminal within a connector housing;

a grommet attached to a wire-led side of the connector; and a rear cover assembled with the wire-led side of the connector while the grommet is present between the rear cover and the connector, wherein the grommet comprises a cover member that covers the wire-led side of the connector, an attitude-holding rib that holds an attitude of the grommet with respect to the rear cover by abutting on an inner wall of the rear cover and a wire-leading cylindrical member, which protrudes outward through the rear cover, and the attitude-holding rib abuts on the inner wall of the rear cover when the rear cover is positioned to the wire-led side of the connector and assembled with the connector.

2. The rear-cover attachment structure according to claim 1, wherein a protruding member abutting on the attitude-holding rib is provided on the inner wall of the rear cover, and the attitude-holding rib and the protruding portion have line contact with each other.

* * * * *